United States Patent [19]

Golay et al.

[11] 4,389,937

[45] Jun. 28, 1983

[54] FUZE FOR NON-SPINNING PROJECTILES

[75] Inventors: Jean-Pierre Golay, Viry; Jean-Louis Uberti, Ferney-Voltaire, both of France

[73] Assignee: Mefina S.A., Fribourg, Switzerland

[21] Appl. No.: 225,601

[22] Filed: Jan. 16, 1981

[30] Foreign Application Priority Data

Jan. 29, 1980 [CH] Switzerland ..... 691/80

[51] Int. Cl.[3] ..... F42C 9/02; F42C 15/04; F42C 15/34

[52] U.S. Cl. ..... 102/249; 102/251; 102/255

[58] Field of Search ..... 102/249, 248, 247, 251, 102/255, 233, 222

[56] References Cited

U.S. PATENT DOCUMENTS

| | | | |
|---|---|---|---|
| 2,537,953 | 1/1951 | Andrews | 102/248 |
| 2,586,437 | 2/1952 | Rabinow | 102/248 |
| 2,709,962 | 6/1955 | Funk et al. | 102/249 |
| 2,732,801 | 1/1956 | Hull et al. | 102/249 |
| 2,836,118 | 5/1958 | Hjelm | 102/248 |
| 2,948,219 | 8/1960 | Sapp | 102/249 |
| 3,157,125 | 11/1964 | Lohmann | 102/249 |
| 3,367,267 | 2/1968 | Combourieux | 102/249 |
| 3,616,756 | 11/1971 | Simmen et al. | 102/249 |

*Primary Examiner*—David H. Brown
*Attorney, Agent, or Firm*—Emory L. Groff, Jr.

[57] ABSTRACT

The fuze comprises a primer-carrying rotor and an inertia mass tensioning a spring under the effect of the acceleration at the start of the explosion. The inertia mass entrains the rotor at the outlet of the firing muzzle in the armed position, under the action of the spring against the retarding action of an anchor rod. The fuze comprises a reduced number of components permitting ensuring successively detonator safety, muzzle safety and a substantial trajectory safety.

5 Claims, 14 Drawing Figures

FUZE FOR NON-SPINNING PROJECTILES

The present invention relates to a projectile fuze having a detonator and muzzle safety device, comprising a primer-carrying rotor pivotally mounted around an axis transverse to the axis of the fuze, and a detonator.

A fuze comprising a detonator safety device and an inertia muzzle safety device co-operating with a clockwork movement after timing of the latter, is disclosed in the U.S. Pat. No. 3,616,756.

It is an object of the invention to provide a simplified device, of great flexibility, calling on less numbers of components than those which are required in the construction in accordance with the U.S. Pat. No. 3,616,756.

The fuze in accordance with the invention is characterized in that it comprises a member tensioned under the effect of the acceleration of the start of the explosion and co-operating with the primer-carrying rotor for displacing it from its safety position into its its armed position, during the deceleration at the outlet of the firing muzzle.

The present invention will be further illustrated, by way of example, with reference to the accompanying drawings, in which.

Figure 5:
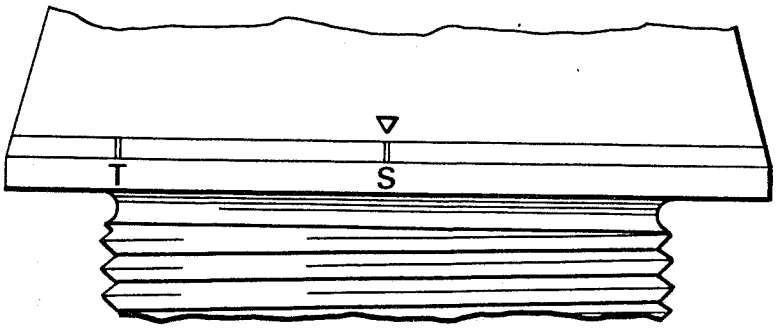
Figure 6:
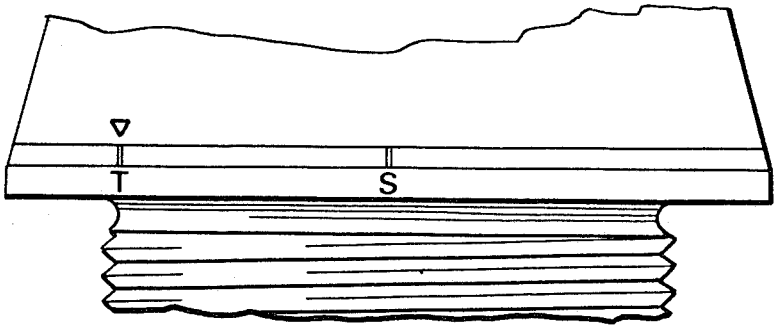
Figure 7:
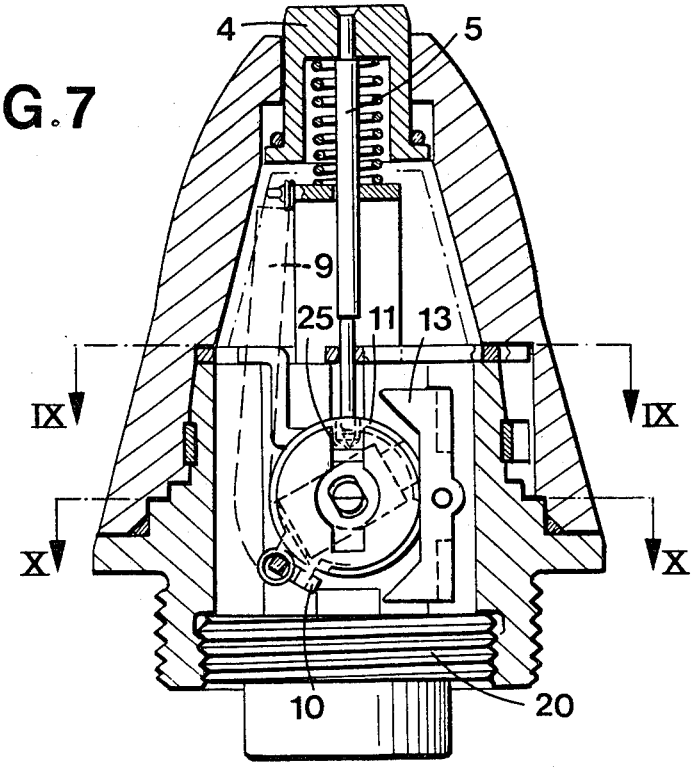

FIGS. 5 and 6 schematically illustrate the unbolting of the detonator safety device;

FIGS. 7 to 10 are views similar to FIGS. 1 to 4, illustrating the unbolting of the muzzle safety device; and FIGS. 11 to 14 are views similar to FIGS. 1 to 4, illustrating the unbolting of the trajectory safety device.

Figure 1:
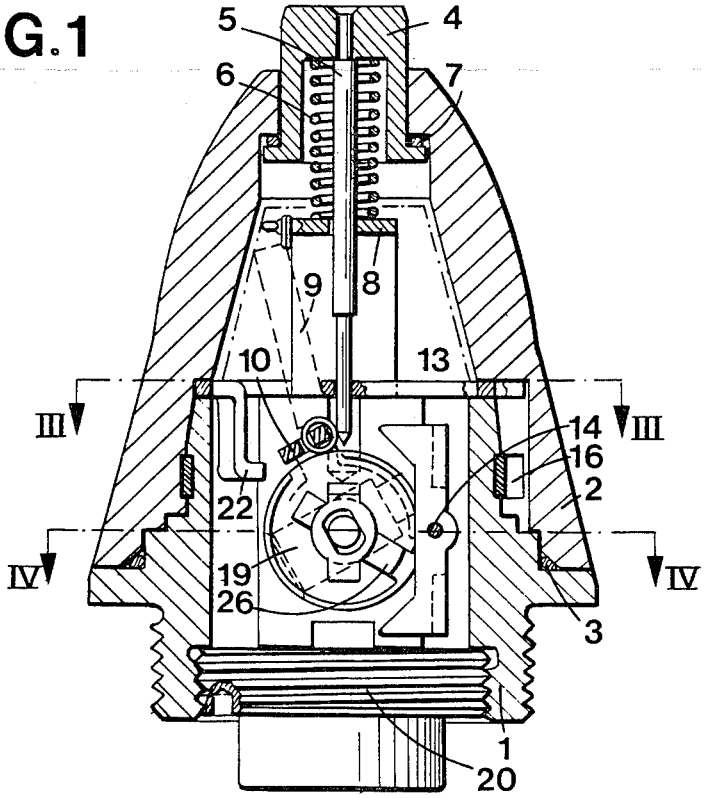
FIG. 1 is an elevational view partially in axial section, of the fuze in the safety position.
Figure 4:
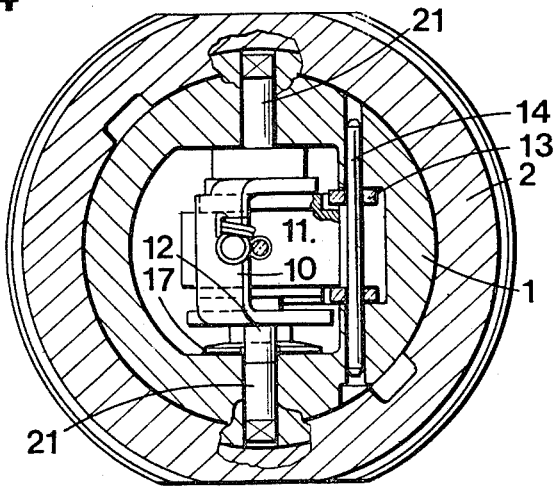
FIGS. 3 and 4 are transverse sectional views along the lines III—III and IV—IV of FIG. 1, respectively.
Figure 2:
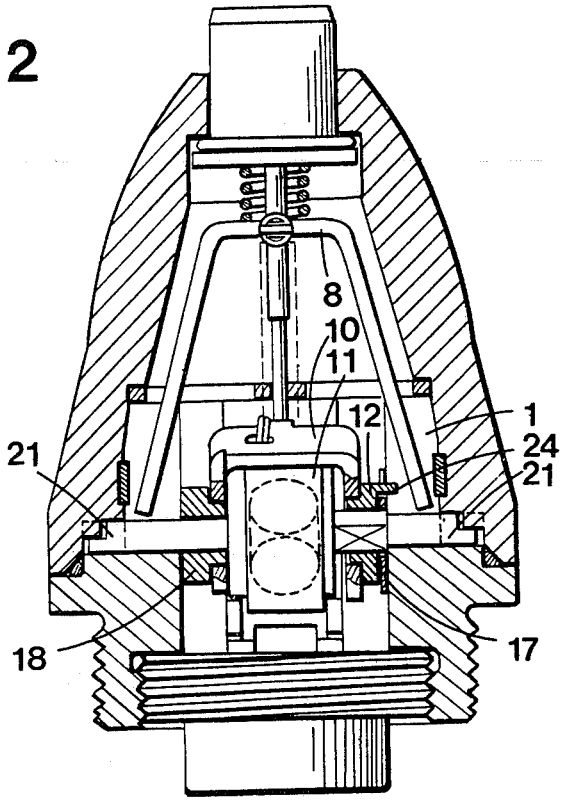
FIG. 2 is a view similar to FIG. 1, partially in axial section, and at 90° with respect to FIG. 1.
Figure 3:
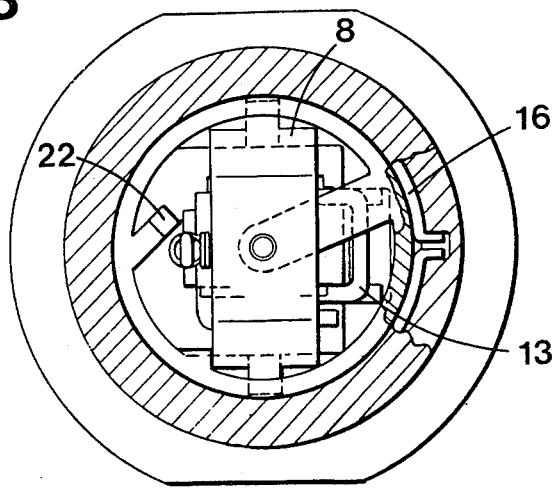

The fuze represented in the drawings comprises a body 1, a cap 2, a friction ring 16 permitting rotation of the cap 2 on the body 1 and two watertight joints 3, 7. A primer-carrying rotor 11 is mounted on two pivots 21, the free ends of each of which present a flat permitting their immobilization between the body 1 and the cap 2 in the safety position (FIGS. 1 to 4). An inertia mass in the form of a stirrup 10 is pivotally mounted on the pivots 21 of the rotor 11, and is connected by a spring 9 to a support 8 disposed in front of the rotor 11 (FIGS. 1 and 2). The stirrup 10 is prevented from pivoting against the action of the spring 9 by a retaining nose 22 secured to the cap 2. A clutch 12, rotatably secured to one of the pivots 21 of the rotor 11 and presenting a nose 24 in mesh with the body 1 of the fuze (see FIG. 2), prevents rotation of the rotor.

There is thus provided detonator safety by the fact of the immobilization of the rotor 11 containing the detonator primer 19 in an inclined position with respect to the axis of the fuze. As represented in FIG. 1, the detonator primer is positioned out of reach of the hammer 5 and removed from the detonator 20.

Figure 10:
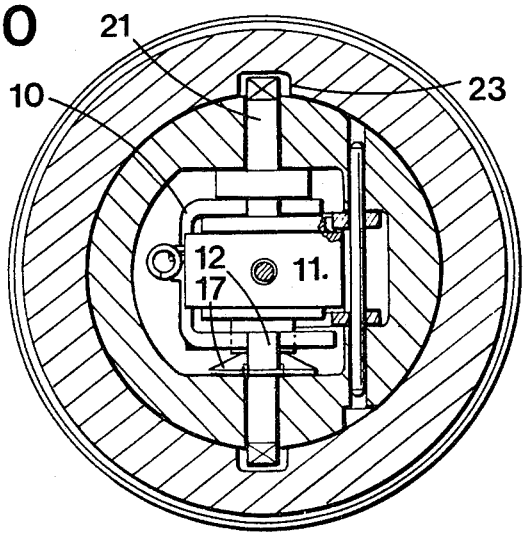
Figure 8:
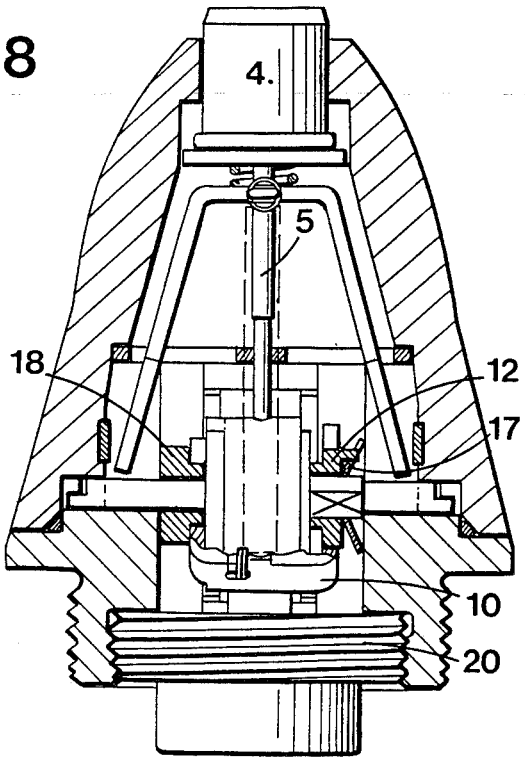
Figure 9:
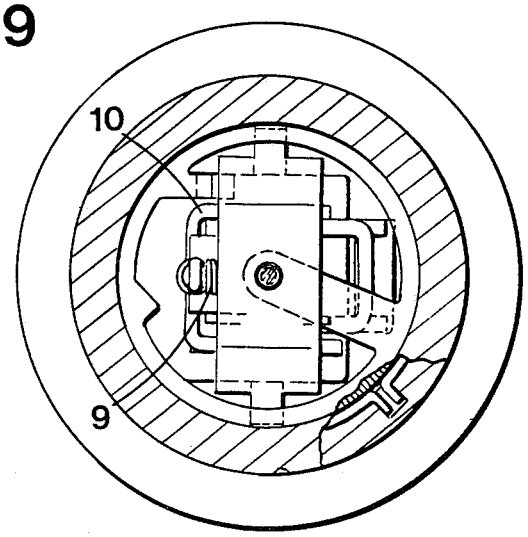
Figure 11:
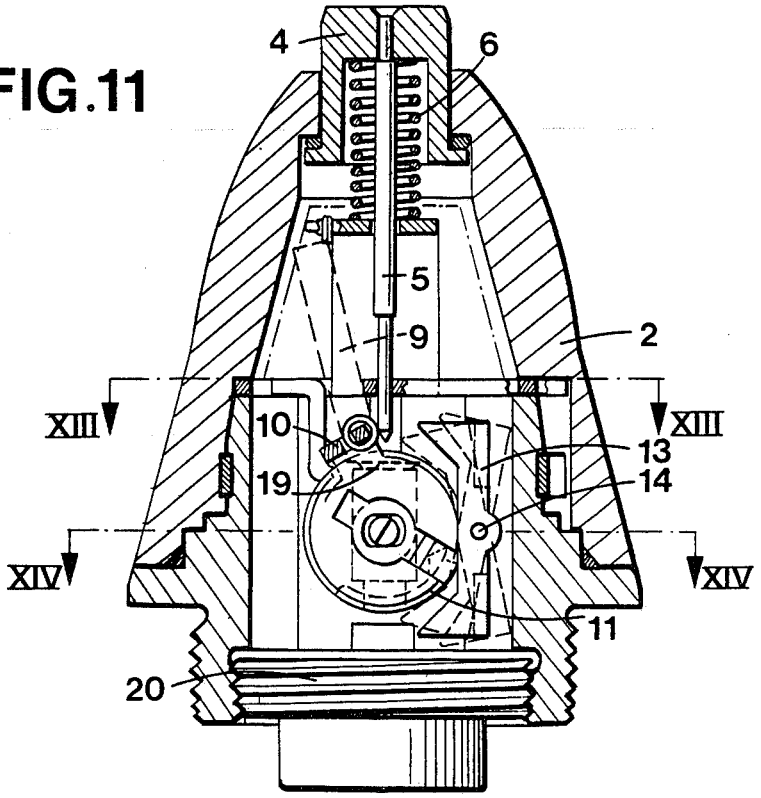
Figure 14:
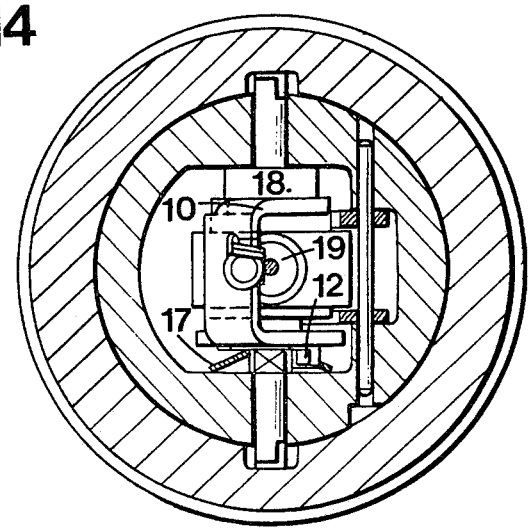
Figure 12:
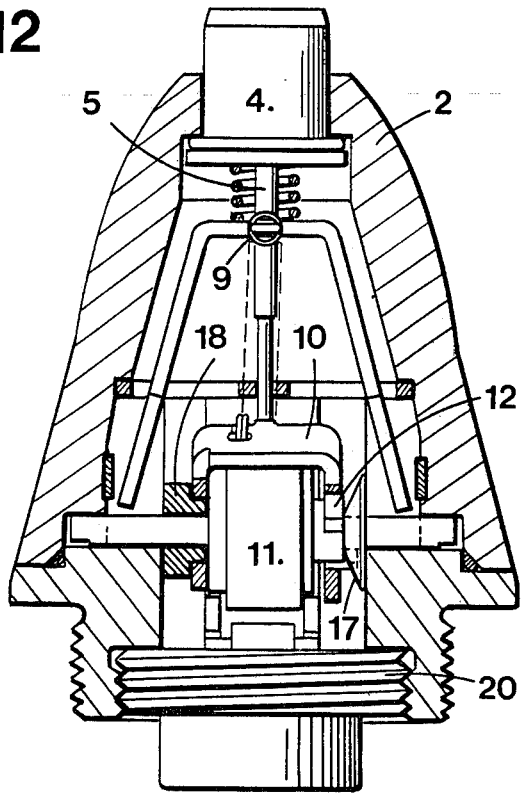
Figure 13:
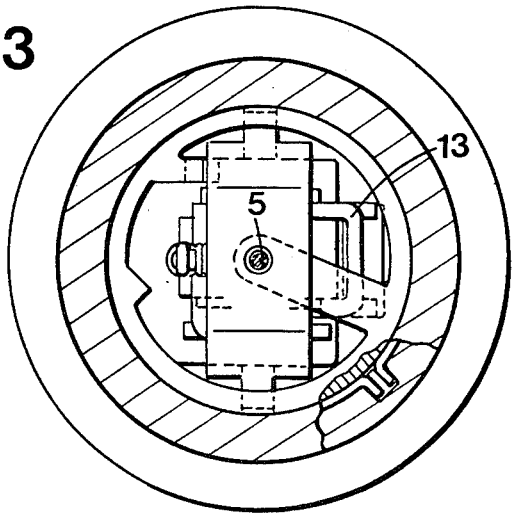

To unbolt the safety device of the detonator of the fuze, it suffices to turn the cap 2 in a clockwise direction with respect to the body of the fuze by an angle limited by the retaining nose 22 (from S to T), as represented in FIGS. 5 and 6. This done, the pivots 21 of the rotor 11 are unbolted, their end flats being engaged in housings 23 of the cap 2 (FIG. 10). Simultaneously, the retaining nose 22 secured to the cap 2 frees the stirrup 10. When the projectile is introduced into the firing muzzle after unbolting of the detonator safety device and fired, the stirrup 10, under the effect of the axial acceleration at the start of the explosion, passes from its position represented in FIGS. 1 and 2 to that represented in FIGS. 7 and 8, with tensioning of the spring 9.

Under the effect of an axial acceleration, the hammer 5 then penetrates into the housing 25 of the rotor 11 and maintains it in its safety position until the projectile emerges from the firing muzzle. Simultaneously, the clutch 12 is pushed back by a spring 17 into a clearance (see FIG. 1) presented by the stirrup 10, thus rendering the rotor 11 rotatably secured to the stirrup 10 (see FIG. 7). This displacement likewise has the effect of releasing the nose 24 from the clutch 12 of the body of the fuze (see FIG. 8).

The stirrup 10 then co-operates with the clutch 12 to pivot the rotor 11 into the armed position under the action of the spring 9. However, so as to ensure the safety of the trajectory of the projectile, an anchor rod 13, 14, meshing with a peripheral toothing of the rotor 11, is provided to slow up the pivoting of this latter into the armed position (see FIG. 11). In this armed position, the detonating primer 19 is in axial alignment with the detonator 20 and the hammer 5, whilst the stirrup 10 has resumed its initial position. On impact of the pin 4 of the hammer 5, the pyrotechnic chain can thus be fired.

The fuze also presents proper safety against sabotage or accidental arming. In fact, the two flats situated at the ends of the pivots 21 of the rotor 11 no longer permits, when the rotor has passed from its FIG. 7 position to its FIG. 11 position, or in all intermediate positions, the cap 2 to be brought back to its FIG. 5 position.

Numerous variations of the construction described and shown in the drawing can be envisaged. Especially, the hammer can be replaced by an electric or electronic firing device, for example.

We claim:

1. A fuze for a non-spinning projectile including a body (1) a cap (2) rotatably mounted on said body, a hammer (5) in said cap, a detonator (20) in said body, a detonator safety device and a muzzle safety device, said fuze comprising pivot means (21) within said body, a rotor (11) mounted on said pivot means between a safety position and an armed position around an axis transverse to the axis of said fuze, a detonator primer (19) carried by said rotor, an inertia mass (10) mounted on said pivot means (21), a support (8) disposed in front of said rotor (11), a first spring (9) connecting said inertia mass (10) to said support (8), retaining means (22) secured to said cap (2) to prevent said inertia mass (10) from pivoting against the action of said spring (9), clutch means (12) rotatably secured to said pivot means (21), said clutch means (12) meshing with said fuze body (1) to prevent rotation of said rotor (11) whereby immobilizing of said rotor in an inclined position with respect to the axis of the fuze places said detonator primer (19) out of reach of said hammer (5) and away from the detonator (20) to provide detonator safety.

2. A fuze according to claim 1 wherein, said clutch means includes a nose (24) which meshes with said fuze body.

3. A fuze according to claim 1 wherein, said pivot means (21) comprises two pivots each of which include a flat portion at their free ends permitting their immobilization between said body (1) and said cap (2) when said fuze is in a safety position, said flat portions of said pivots also preventing return of said cap to its detonator safety position once said rotor is no longer in the safety position thereby providing security against sabotage or accidental arming of said projectile.

4. A fuze according to claim 1 wherein, rotation of said cap (2) relative to said body releases said pivot means (21) and said rotor (11) mounted thereon and also releases said retaining means (22) thus freeing said inertia mass (10) and unlocking said detonator (20).

5. A fuze according to claim 4 including, a second spring (17) engaging said clutch (12) to rotatably secure said rotor (11) to said inertia mass (10) under the effect of axial acceleration when said projectile is fired.

* * * * *